US008522855B2

(12) United States Patent
Lin

(10) Patent No.: US 8,522,855 B2
(45) Date of Patent: Sep. 3, 2013

(54) SUNSHADE

(75) Inventor: Paul Lin, Tainan (TW)

(73) Assignee: MACAUTO Industrial Co., Ltd., Tainan (TW)

( * ) Notice: Subject to any disclaimer, the term of this patent is extended or adjusted under 35 U.S.C. 154(b) by 14 days.

(21) Appl. No.: 13/049,633

(22) Filed: Mar. 16, 2011

(65) Prior Publication Data

US 2011/0315327 A1 Dec. 29, 2011

(30) Foreign Application Priority Data

Jun. 25, 2010 (TW) ..... 99120813 A

(51) Int. Cl.
*E06B 9/17* (2006.01)

(52) U.S. Cl.
USPC ..... 160/324; 160/325; 160/326

(58) Field of Classification Search
USPC ..... 160/324, 325, 326, 323.1, 318, 24, 160/903; 292/163
See application file for complete search history.

(56) References Cited

U.S. PATENT DOCUMENTS

| | | | | |
|---|---|---|---|---|
| 1,090,931 | A * | 3/1914 | McLean | 160/313 |
| 2,755,120 | A * | 7/1956 | Young et al. | 292/74 |
| 8,151,859 | B2 * | 4/2012 | Koop et al. | 160/325 |
| 2011/0315327 | A1 * | 12/2011 | Lin | 160/305 |

* cited by examiner

*Primary Examiner* — Blair M. Johnson
(74) *Attorney, Agent, or Firm* — Brinks Hofer Gilson & Lione

(57) ABSTRACT

A sunshade includes a roller, a screen wound on the roller, a torque unit, and a latch unit. The torque unit is mounted in the roller, extends outwardly of the roller, and is disposed for urging movement of the screen to a wound state. The latch unit includes a plug disposed in the roller and formed with a pin hole, a pin member, and a biasing member disposed in the roller. The pin member has a main portion (521) extending movably through the pin hole, a diameter-enlarged portion disposed in the roller and connected fixedly to the main portion, and a shoulder portion formed between the main portion and the diameter-enlarged portion and biased by the biasing member to abut resiliently against the plug.

3 Claims, 5 Drawing Sheets

SUNSHADE

CROSS-REFERENCE TO RELATED APPLICATION

This application claims priority of Taiwanese Application No. 099120813, filed on Jun. 25, 2010.

BACKGROUND OF THE INVENTION

1. Field of the Invention

The present invention relates to a sunshade, more particularly to a sunshade which facilitates assembly thereof to a pair of mounting seats.

2. Description of the Related Art

Referring to FIG. 1, a conventional sunshade includes a roller 11 extending in an axial direction (X), a screen 10 wound on the roller 11, a torque unit 13, and a pin unit 12 spaced apart from the torque unit 13. The pin unit 12 and the torque unit 13 are mounted in the roller 11 and extend respectively and outwardly of axially opposite ends of the roller 11. The pin unit 12 is inserted into another mounting seat 20', and the torque unit 13 has an axle 131 that extends outwardly of the roller 11 and that is inserted into a mounting seat 20. The mounting seat 20 includes a main body 21 and a cover body 22. The main body 21 is formed with a notch 210 for receiving the axle 131. When assembling the sunshade to the mounting seats 20', 20, the pin unit 12 is engaged with a mounting hole 201' in the mounting seat 20', and the axle 131 of the torque unit 13 is twisted relative to the roller 11 before being inserted into the notch 210 of the main body 21. Subsequently, the cover body 22 is covered on and secured to the main body 21 so as to position the axle 131 of the torque unit 13 in the notch 210. However, the assembling procedure of the conventional sunshade to the mounting seats 20, 20' is relatively inconvenient and time consuming.

SUMMARY OF THE INVENTION

Therefore, the object of the present invention is to provide a sunshade which can facilitate assembly thereof to a pair of mounting seats.

Accordingly, a sunshade of the present invention comprises:

a hollow roller extending in an axial direction;

a screen wound on the roller, and being operable to move from a wound state to an unwound state; and a torque unit mounted in the roller, extending outwardly of a first end of the roller and disposed for urging movement of the screen to move from the unwound state to the wound state; and a latch unit including a plug that is disposed in the roller at a second end of the roller opposite to the torque unit and that is formed with a pin hole, a pin member that is movable relative to the plug in the axial direction and that has:

a main portion extending through the pin hole of the plug; and a diameter-enlarged portion disposed in the roller, connected fixedly to the main portion and having an outer diameter larger than that of the main portion; and a shoulder portion formed between the main portion and the diameter-enlarged portion; and a biasing member that is disposed in the roller for biasing the shoulder portion of the pin member to abut resiliently against the plug.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 2:
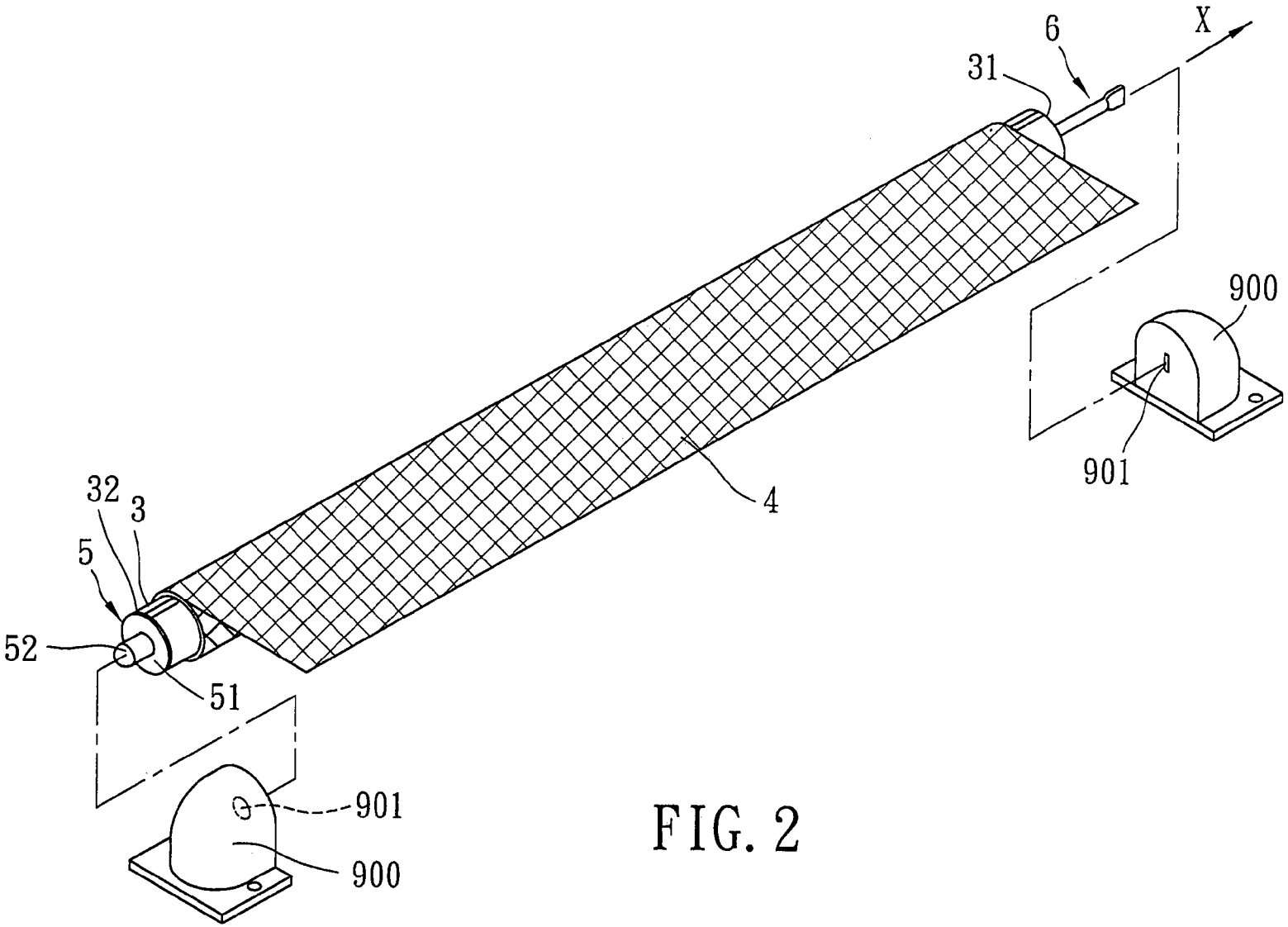
FIG. 2 is a partly exploded perspective view of a preferred embodiment of a sunshade according to the present invention.
Figure 3:
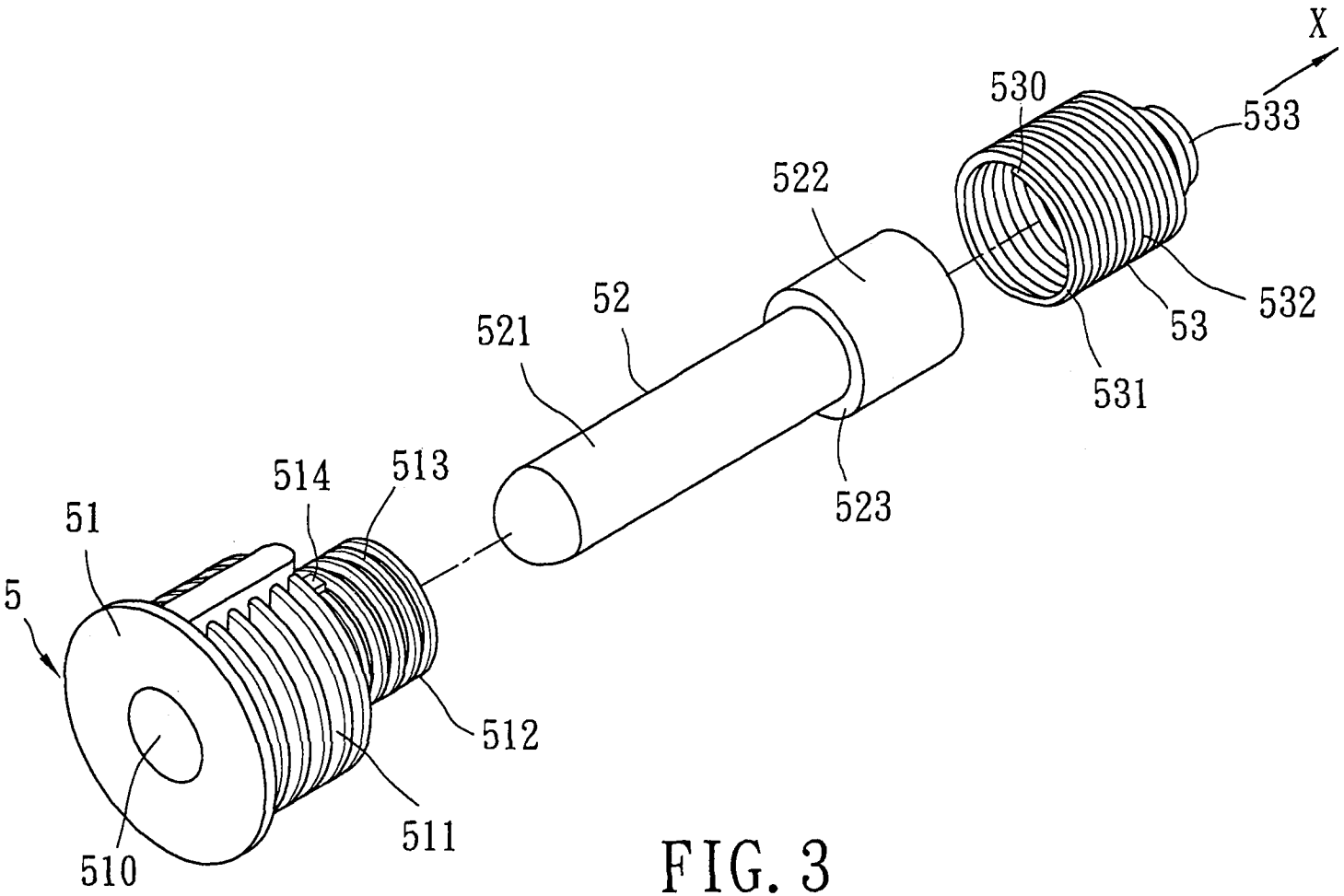
FIG. 3 is an exploded perspective view of a latch unit of the preferred embodiment.
Figure 4:
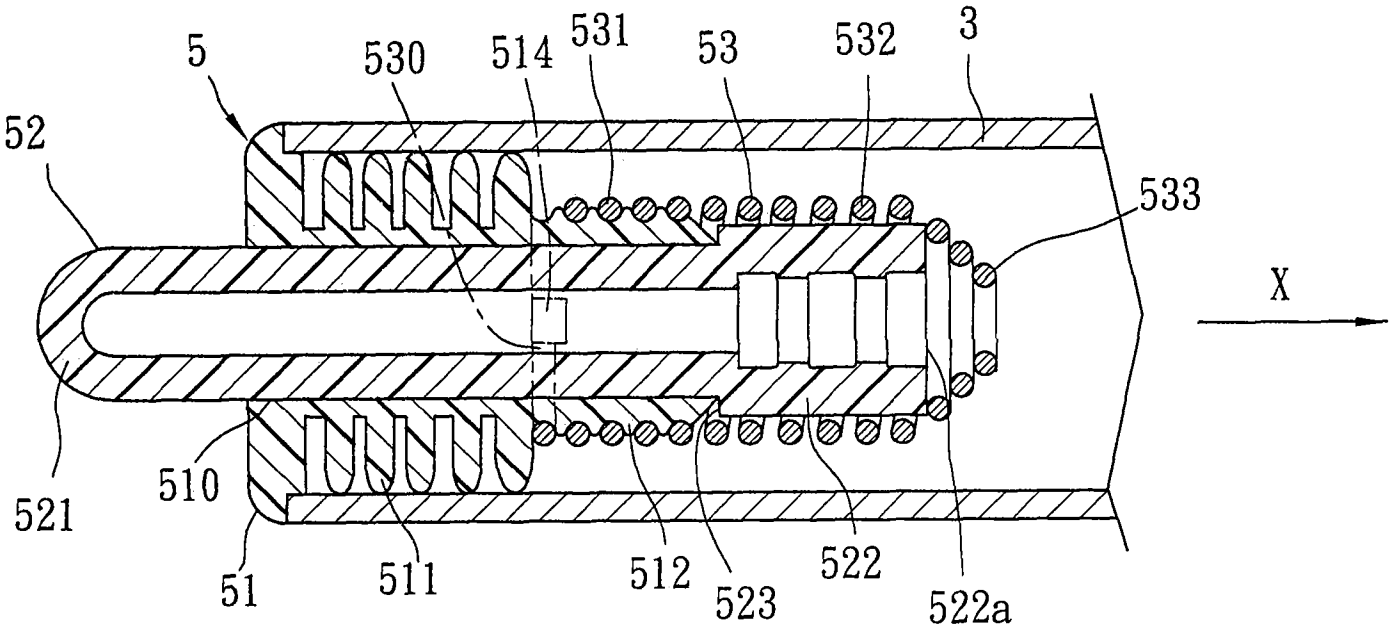
FIG. 4 is a fragmentary sectional view of the preferred embodiment, illustrating a pin member at a normal position.

Referring to FIGS. 2 to 4, a preferred embodiment of a sunshade according to the present invention is shown to comprise a hollow roller 3 extending in an axial direction (X), a screen 4, a torque unit 6, and a latch unit 5. The screen 4 is wound on the roller 3, and is operable to move from a wound state to an unwound state. The torque unit 6 is mounted in the roller 3, extends outwardly of a first end 31 of the roller 3, and is disposed for urging movement of the screen 4 from the unwound state to the wound state. The latch unit 5 is spaced apart from the torque unit 6 in the axial direction (X). The latch unit 5 and the torque unit 6 are adapted to be mounted respectively to a pair of mounting seats 900 (see FIG. 2). Since the feature of this invention does not reside in the torque unit 6 and the screen 4, further details of the same are omitted herein for the sake of brevity.

The latch unit 5 includes a plug 51, a pin member 52, and a biasing member 53. The plug 51 is disposed in the roller 3 at a second end 32 of the roller 3 axially opposite to the torque unit 6, and is formed with a pin hole 510. The pin member 52 is movable relative to the plug 51 in the axial direction (X). The biasing member 53 is disposed in the roller 3 for biasing the pin member 52 to move toward the plug 51 in the axial direction (X).

The pin member 52 includes a main portion 521 that extends movably through the pin hole 510 of the plug 51, a diameter-enlarged portion 522 that is disposed in the roller 3, that is connected fixedly to the main portion 521 and that has an outer diameter larger than that of the main portion 521, and a shoulder portion 523 that is formed between the main portion 521 and the diameter-enlarged portion 522 (i.e., the main portion 521 and the diameter-enlarged portion 522 are respectively distal from and proximate to the torque unit 6 in the axial direction (X)). The diameter-enlarged portion 522 has an end face **522*a* opposite to the shoulder portion 523** in the axial direction (X).

The plug 51 includes a fixing portion 511 engaging fittingly the second end 32 of the roller 3, and a positioning portion 512 that extends from the fixing portion 511 in the roller 3 toward the torque unit 6, and that has an externally threaded surrounding wall 513. The main portion 521 of the pin member 52 extends movably through the fixing portion 511 and the positioning portion 512.

The biasing member 53 is a coil spring in this embodiment, and includes an engaging segment 531, a positioning segment 533, and an interconnecting segment 532. The engaging segment 531 engages threadedly the externally threaded surrounding wall 513 of the positioning portion 512 of the plug 51. The positioning segment 533 is coupled to the end face 522*a* of the diameter-enlarged portion 522 of the pin member 52, has an inner diameter smaller than the outer diameter of the diameter-enlarged portion 522 and reducing gradually toward the torque unit 6 in the axial direction (X), and is disposed for biasing the shoulder portion 523 to abut resiliently against the positioning portion 512 of the plug 51 in the axial direction (X). The interconnecting segment 532 interconnects the engaging segment 531 and the positioning segment 533 and surrounds the diameter-enlarged portion 522.

The plug 51 further has a block protrusion 514 formed on the positioning portion 512 thereof adjacent to the fixing portion 511. The engaging segment 531 of the biasing member 53 has an end 530 that is axially opposite to the interconnecting segment 532 and that abuts circumferentially for positioning the engaging segment 531 relative to the positioning portion 511 of the plug 51 against the block protrusion 514.

Figure 5:
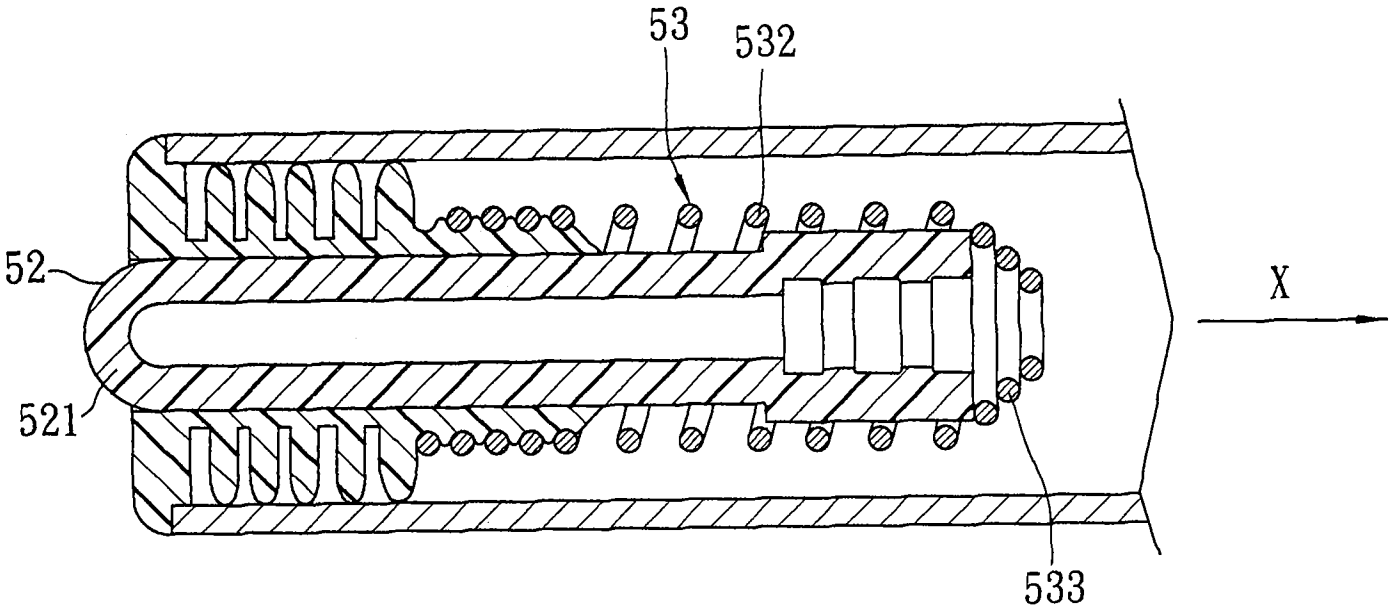
FIG. 5 is another fragmentary sectional view of the preferred embodiment, illustrating the pin member at a retracted position.

When assembling the sunshade, the torque unit 6 is twisted relative to the roller 3 and is inserted into a mounting hole 901 of a corresponding one of the mounting seats 900. Afterward, further referring to FIG. 5, the pin member 52 is pressed toward the torque unit 6 from a normal position (see FIG. 4) to a retracted position (see FIG. 5) such that the positioning segment 533 of the biasing member 53 is brought to move toward the torque unit 6 and the interconnecting segment 532 of the biasing member 53 is stretched in the axial direction (X). Finally, the main portion 521 of the pin member 52 is aligned with a mounting hole 901 of the corresponding one of the mounting seats 900, and is released to be inserted into the mounting hole 901 by a restoring force of the biasing member 53.

It should be noted that, while the biasing member 53 is connected to the plug 51 by the engaging segment 531 thereof and is coupled to the diameter-enlarged portion 522 of the pin member 52 by the positioning segment 533 thereof, the connecting member 53 should not be limited thereto. The biasing member 53 may be connected to the plug 51 and the pin member 52 in other manner in other embodiments of this invention as long as opposite ends of the biasing members 53 are secured respectively to the diameter-enlarged portion 522 of the pin member 52 and the plug 51.

Figure 1:
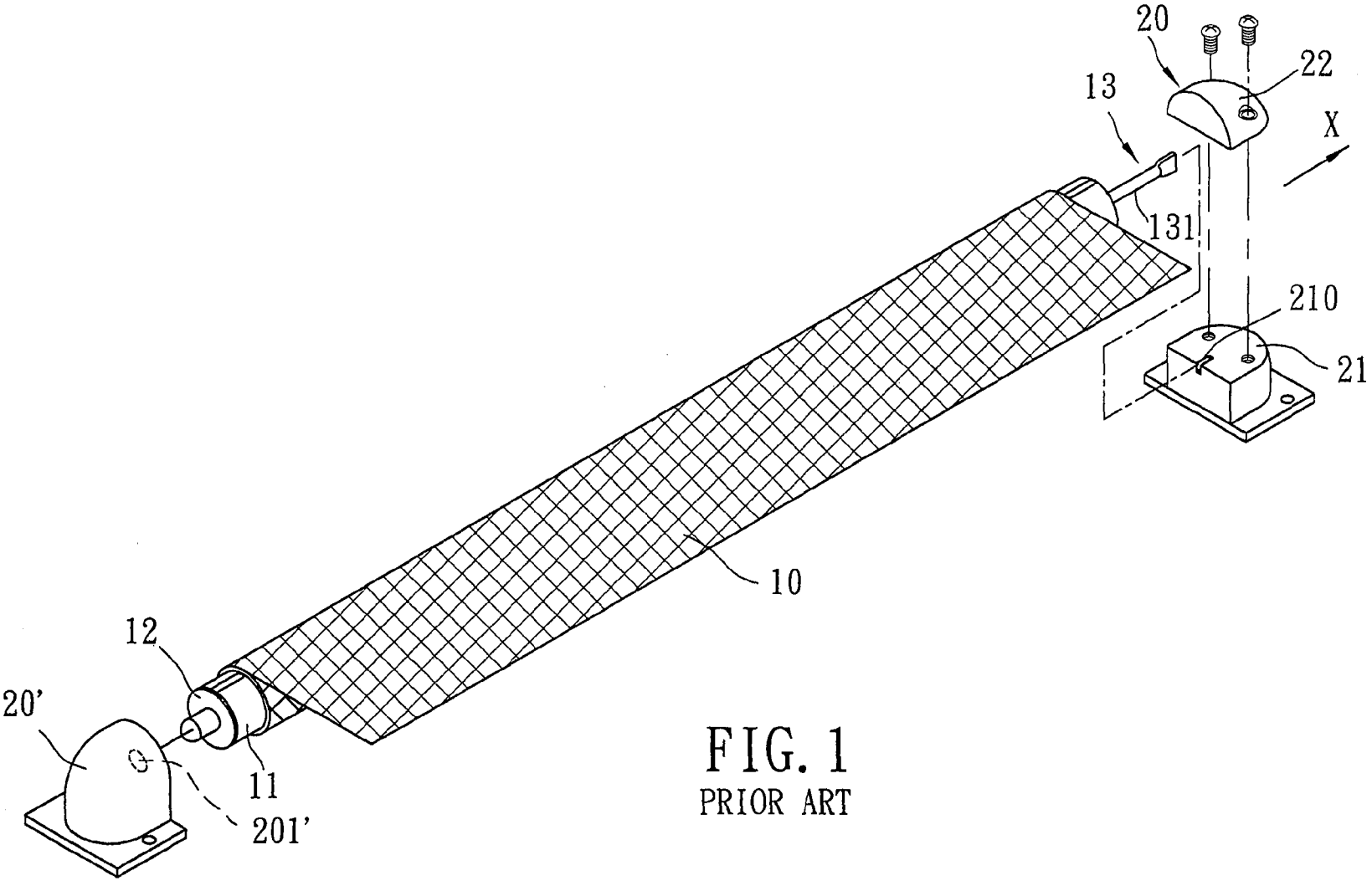
FIG. 1 PRIOR ART
FIG. 1 is a partly exploded perspective view of a conventional sunshade assembly.

To sum up, the advantage of the sunshade according to the present invention is as follows. Compared to the conventional sunshade, the configuration of the latch unit 5 makes it easy to assemble the sunshade to the mounting seats 900. Further, the configuration of the mounting seats 900 as illustrated in FIG. 1 may be simplified.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A sunshade comprising: a hollow roller extending in an axial direction; a screen wound on said roller, and operable to move from a wound state to an unwound state; and a torque unit mounted in said roller, extending outwardly of a first end of said roller and disposed for urging movement of said screen from the unwound state to the wound state; and a latch unit including a plug that is disposed in said roller at a second end of said roller opposite to said torque unit and that is formed with a pin hole, a pin member that is movable relative to said plug in the axial direction and that has: a main portion extending through said pin hole of said plug, and a diameter-enlarged portion disposed in said roller, connected fixedly to said main portion, and having an outer diameter larger than that of said main portion, and a shoulder portion formed between said main portion and said diameter-enlarged portion; and a biasing member that is disposed in said roller for biasing said shoulder portion of said pin member to move to abut resiliently against said plug, wherein said plug includes a fixing portion engaging fittingly said second end of said roller, and a positioning portion that extends from said fixing portion in said roller toward said torque unit, and that has an externally threaded surrounding wall, said main portion of said in member extending movably through said fixing and positioning portions of said plug, said biasing member including: an engaging segment that engages said externally threaded surrounding wall of said positioning portion of said plug; a positioning segment that is coupled to said diameter-enlarged portion of said pin member and that biases said shoulder portion of said pin member to abut resiliently against said positioning portion of said plug; and an interconnecting segment that interconnects said engaging segment and said positioning segment; wherein, when said pin member is pressed toward said torque unit, said positioning segment of said biasing member is brought to move toward said torque unit and said interconnecting segment of said biasing member is stretched in the axial direction.

2. The sunshade as claimed in claim 1, wherein said diameter-enlarged portion of said pin member has an end face opposite to said shoulder portion in the axial direction, said positioning segment of said biasing member having a distal end opposite to said interconnecting segment in the axial direction, and abutting against said end face to bias said diameter-enlarged portion toward said positioning portion of said plug.

3. The sunshade as claimed in claim 1, wherein said plug further has a block protrusion formed on said positioning portion thereof adjacent to said fixing portion, said engaging segment of said biasing member having an end that is axially opposite to said interconnecting segment and that abuts circumferentially against said block protrusion.

* * * * *